US008274388B2

(12) United States Patent
Li

(10) Patent No.: US 8,274,388 B2
(45) **Date of Patent: *Sep. 25, 2012**

(54) ANTI-THEFT SECURITY MARKER WITH SOFT MAGNETIC BIAS COMPONENT

(75) Inventor: Lin Li, BeiLun (CN)

(73) Assignee: Ningbo Signatronic Technologies, Ltd., Ningbo, BeiLun (CN)

( * ) Notice: Subject to any disclaimer, the term of this patent is extended or adjusted under 35 U.S.C. 154(b) by 522 days.

This patent is subject to a terminal disclaimer.

(21) Appl. No.: 12/582,696

(22) Filed: Oct. 20, 2009

(65) Prior Publication Data

US 2010/0052906 A1 Mar. 4, 2010

Related U.S. Application Data

(62) Division of application No. 11/602,109, filed on Nov. 20, 2006, now Pat. No. 7,626,502.

(51) Int. Cl.
*G08B 13/14* (2006.01)

(52) U.S. Cl. ..... 340/572.1; 340/572.6

(58) Field of Classification Search ..... 340/572.1, 340/572.6, 572.8, 568.1
See application file for complete search history.

(56) References Cited

U.S. PATENT DOCUMENTS

| | | | | |
|---|---|---|---|---|
| 4,510,489 | A | 4/1985 | Anderson | 340/572 |
| 4,536,229 | A | 8/1985 | Jin | 148/31.55 |
| 5,351,033 | A | 9/1994 | Liu | 340/572 |
| 5,716,460 | A | 2/1998 | Manning | 148/120 |
| 5,729,200 | A | 3/1998 | Copeland | 340/551 |
| 5,780,175 | A * | 7/1998 | Chen et al. | 428/812 |
| 5,885,371 | A * | 3/1999 | Komatsubara et al. | 148/113 |
| 6,001,194 | A | 12/1999 | Nakaoka | 148/306 |
| 6,181,245 | B1 | 1/2001 | Copeland | 340/551 |
| 6,359,563 | B1 | 3/2002 | Herzer | 340/572.6 |
| 6,426,700 | B1 * | 7/2002 | Lian et al. | 340/572.6 |
| 6,689,490 | B2 | 2/2004 | Weber | 428/682 |
| 6,707,649 | B2 * | 3/2004 | Hasegawa et al. | 360/324.12 |
| 6,893,511 | B1 | 5/2005 | Nakaoka | 148/121 |
| 2004/0207528 | A1 * | 10/2004 | Fabian et al. | 340/572.6 |

* cited by examiner

*Primary Examiner* — John A Tweel, Jr.
(74) *Attorney, Agent, or Firm* — Miller Law Group, PLLC

(57) ABSTRACT

An acoustic-magneto (AM) anti-theft marker is formed with the bias piece made from a soft magnetic material, instead of a "semi-hard" magnetic material that has been used in conventional anti-theft AM security markers. The method of manufacturing such soft magnetic bias pieces includes cold deforming a soft magnetic material with at least an eighty percent reduction rate, while keeping its DC coercivity below 12.5 Oe. The strip or wire of soft magnetic material is then cut to size as required for the bias piece. The anti-theft AM security marker has the soft magnetic bias piece placed inside or outside of the resonating cavity of the housing for the security tag with the resonator pieces inside the resonating cavity with a cover film placed over the housing. The soft magnetic bias piece or pieces effectively operate close to resonator piece or pieces with or without a non-magnetic separating film.

20 Claims, 9 Drawing Sheets

Fig. 1

| Alternating Current Coercivity of a 49 Ni-Fe Soft Magnetic Bias Strip at Different Frequencies | | | | |
|---|---|---|---|---|
| Freq. (kHz) | Bm (mT) x 1.2 | Br (mT) x 1.2 | Hm (Oe) | AC Hc (Oe) |
| 1: 0.1 | 892.13 | 400.19 | 49.958 | 8.4449 |
| 2: 0.4 | 918.02 | 422.88 | 49.935 | 8.3721 |
| 3: 0.8 | 922.62 | 425.46 | 50.017 | 9.0300 |
| 4: 1.5 | 921.56 | 423.38 | 49.910 | 9.2177 |
| 5: 5.0 | 923.61 | 426.60 | 49.946 | 9.9257 |
| 6: 10.0 | 921.94 | 426.22 | 49.968 | 10.9160 |
| 7: 25.0 | 934.27 | 441.52 | 50.282 | 12.5500 |
| 8: 58.0 | 909.77 | 451.57 | 49.590 | 13.5100 |
| 9: 60.0 | 904.76 | 447.29 | 49.960 | 13.2520 |
| Sample: | L = 35 mm<br>W = 0.12 g | A = 0.42 $mm^2$<br>N1 = 40 | V = 14.7 $mm^3$<br>N2 = 110 | |

Fig. 3
Prior Art
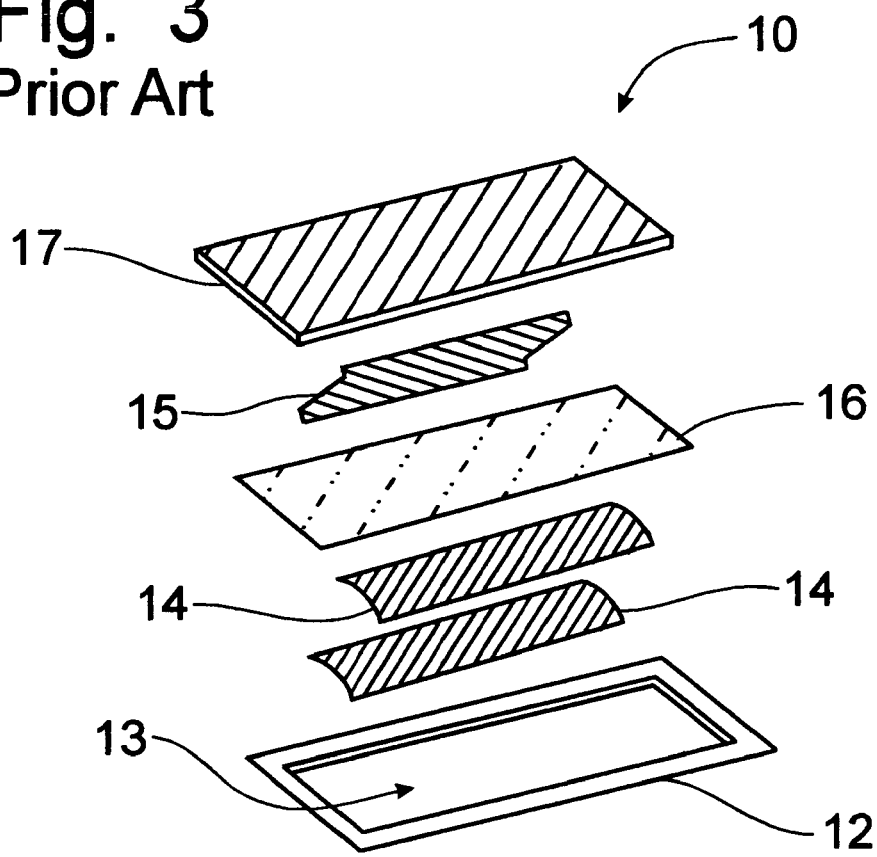
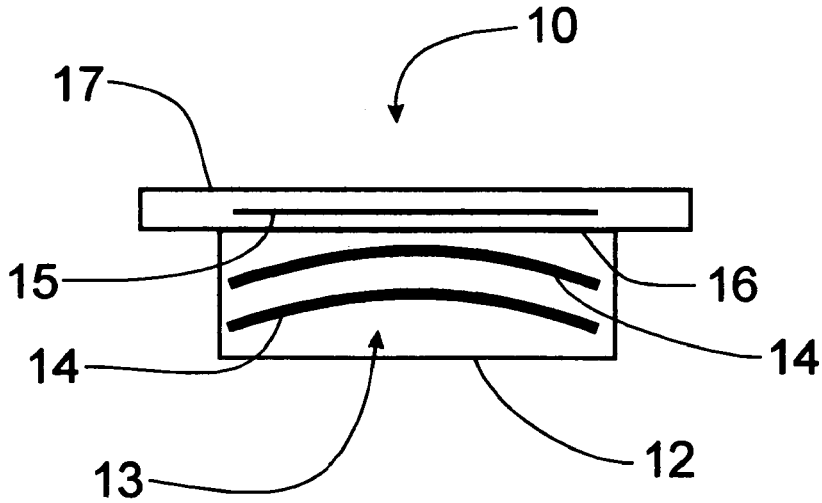
Fig. 4
Prior Art

Fig. 5
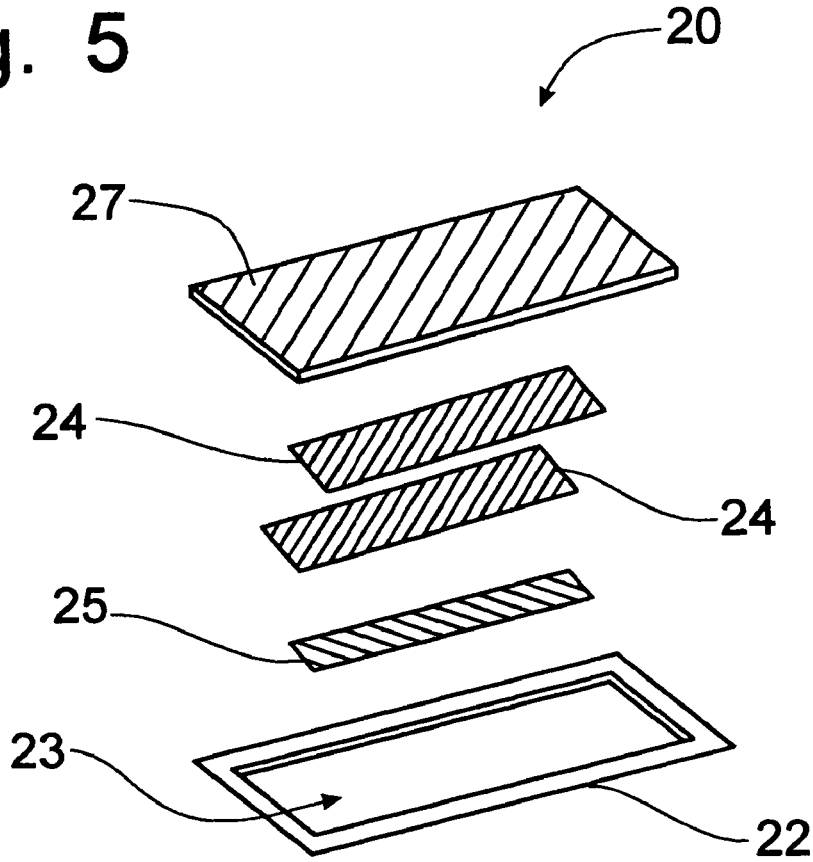
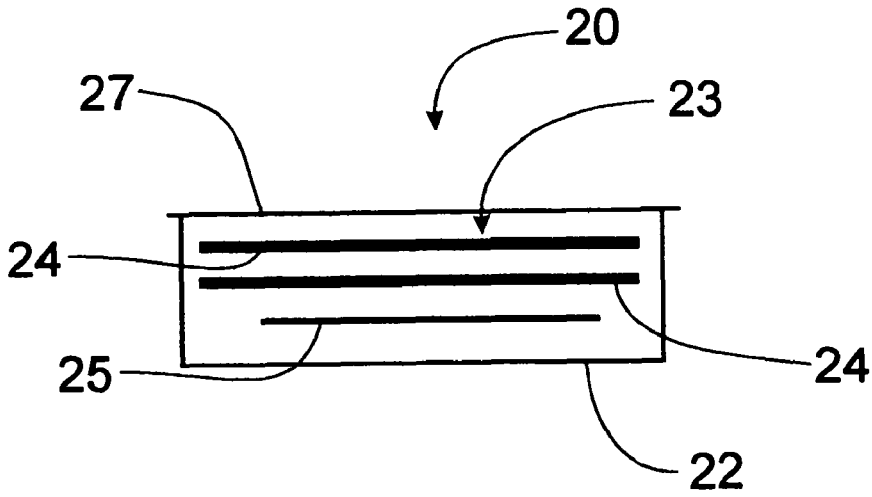
Fig. 6

Fig. 7
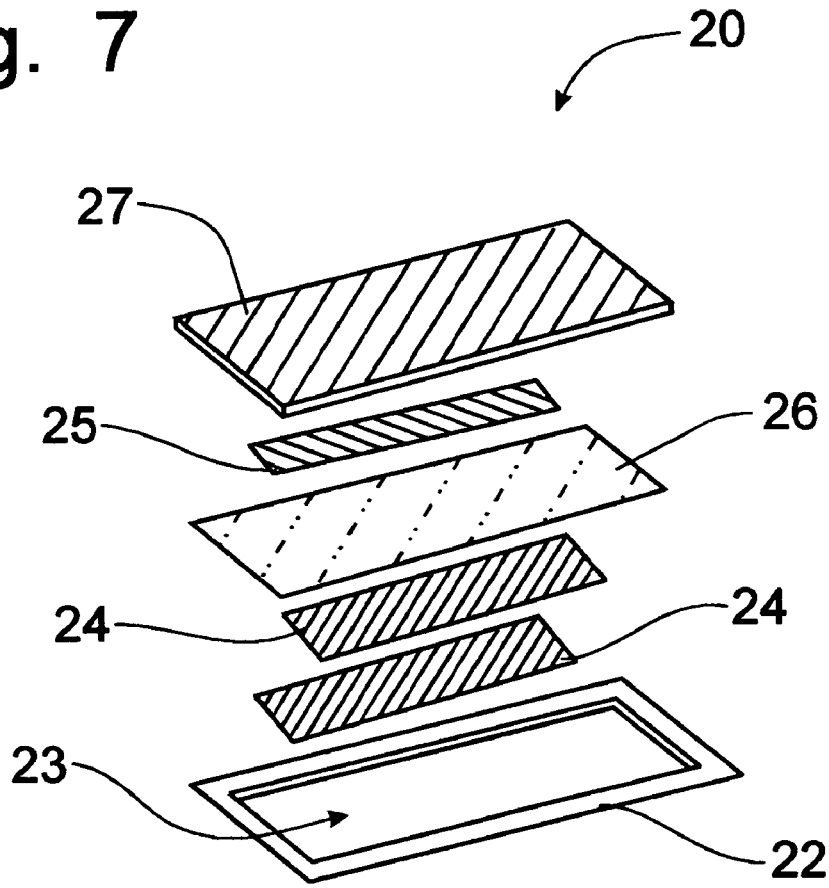
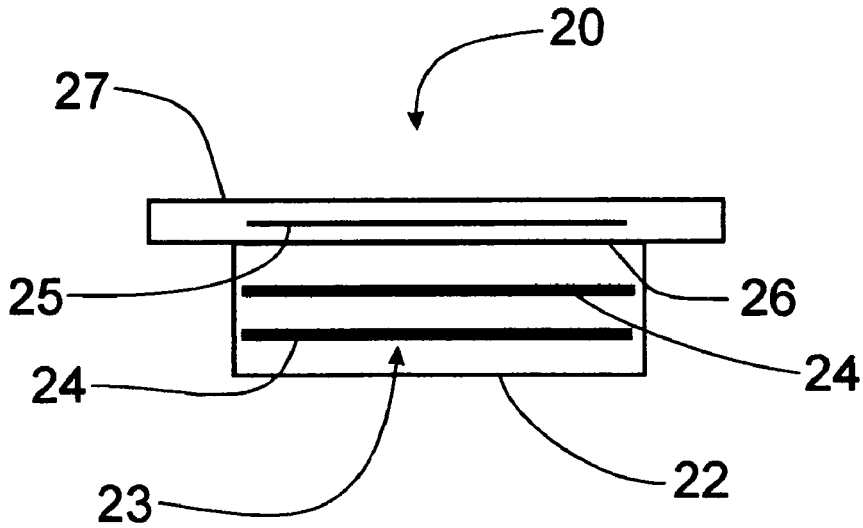
Fig. 8

Fig. 10
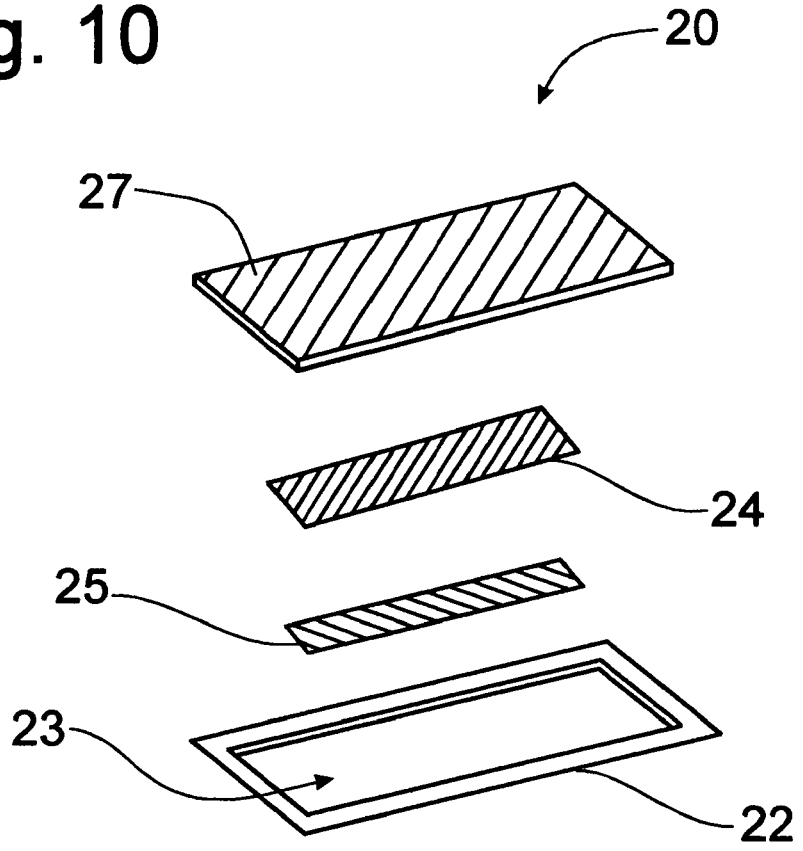
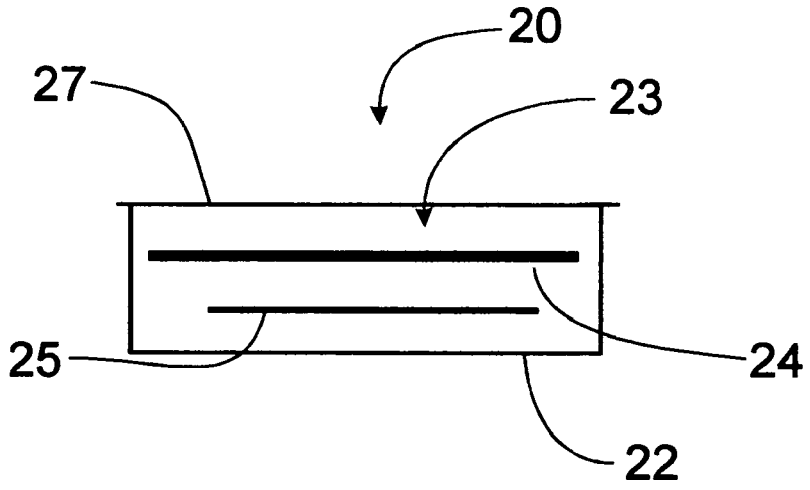
Fig. 11

Fig. 12
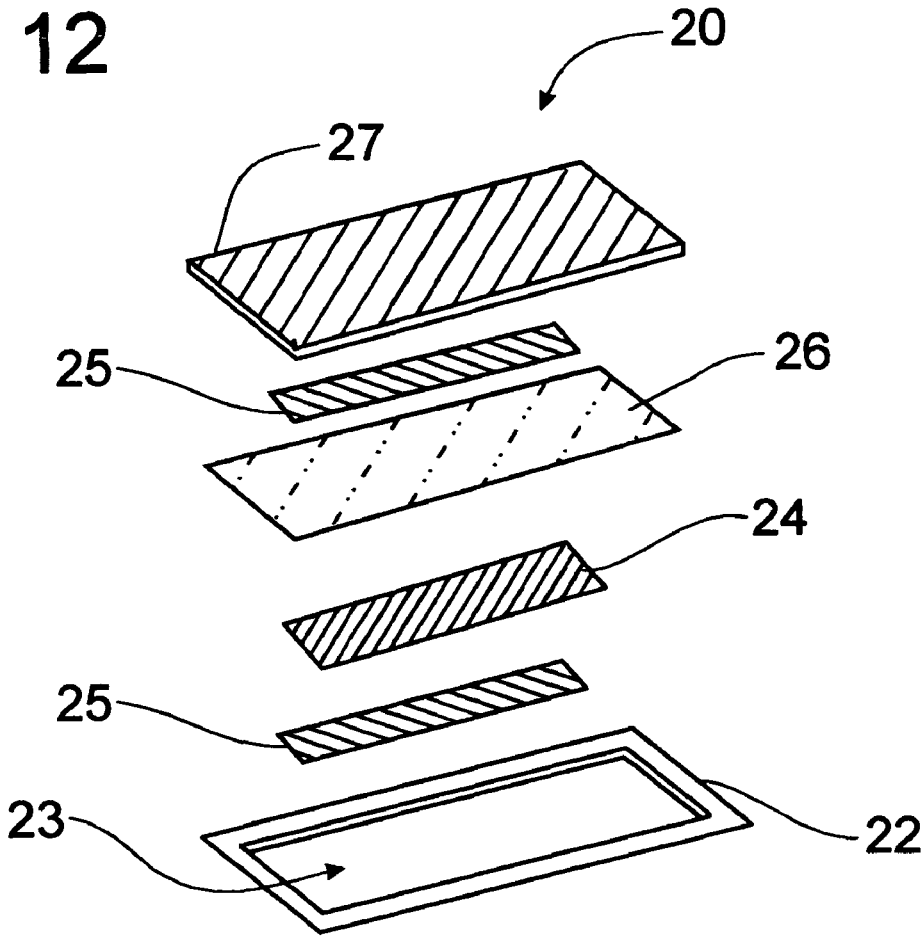
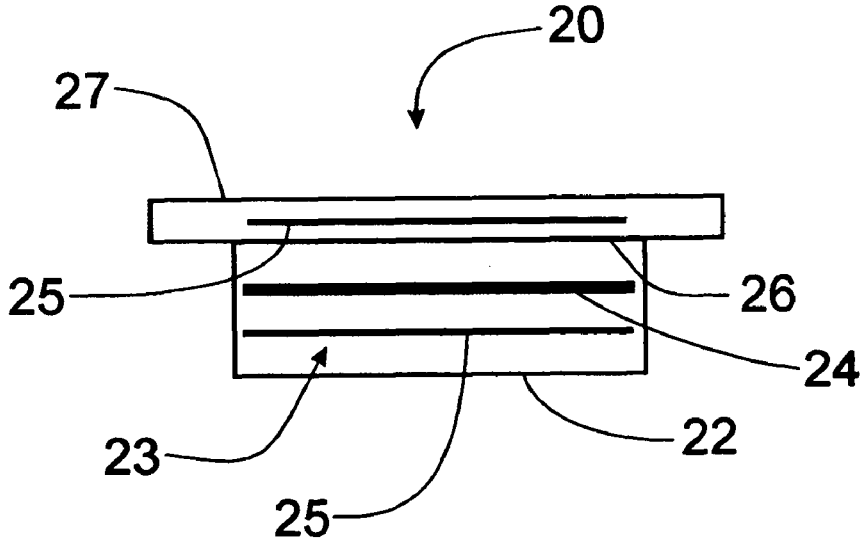
Fig. 13

ANTI-THEFT SECURITY MARKER WITH SOFT MAGNETIC BIAS COMPONENT

CROSS-REFERENCE TO RELATED APPLICATIONS

This application is a division of U.S. patent application Ser. No. 11/602,109, filed on Nov. 20, 2006, and entitled "Anti-Theft Security Marker with Soft Magnetic Bias Component", issued as U.S. Pat. No. 7,626,502, on Dec. 1, 2009.

FIELD OF THE INVENTION

This invention relates to an electronic article surveillance (EAS) device and, more specifically to acoustic-magneto anti-theft markers using soft magnetic materials as the bias component, as well as the method of manufacturing such bias components and markers.

BACKGROUND OF THE INVENTION

The acoustic-magneto (AM) technology has been used in the electronic article surveillance industry for over two decades. The early form of this AM technology is disclosed in U.S. Pat. No. 4,510,489 granted to Philip Anderson III, et al on Apr. 9, 1985, and assigned to Allied Corporation. This Anderson patent disclosed that certain amorphous ribbons demonstrated high magneto-mechanical coupling factor. Therefore, the cut ribbons can emit strong resonant signals under proper bias fields. This Anderson patent led to the commercial AM anti-theft devices that are widely used in retail markets today.

Such an AM anti-theft device includes a detecting system, markers, a marker deactivator, and marker verifiers. Currently, a widely used commercial product is marketed as the Ultra-max® system made by Sensormatic Electronics Corporation (SEC). This Ultra-max® system emits a 58 kHz pulse field to excite active markers and induce strong resonant signals around 58 kHz. The pick-up coils detect and amplify such induced resonant signals, analyzing the "ring-down" characteristics, then set off an alarm if this specific marker's signal profile is detected. The markers can be selectively deactivated to prevent the alarm from being triggered. This deactivation involves a demagnetization of the bias piece inside an activated marker, which shifts the resonant frequency away from 58 kHz and reduces the signal amplitude. Therefore, the alarm will not be triggered when deactivated markers passing through interrogation zone.

The AM anti-theft markers can be classified into two types: permanent tags and disposable labels. The permanent tag uses an amorphous ribbon as a resonator and permanent magnets (e.g. hard ferrite magnets) as the bias material that cannot be easily deactivated. Permanent tags were not as convenient to use, as the mechanical lockers have to be manually unlocked by the cashier when customers paid for the articles that were protected by attached permanent tags.

The prior disposable labels use the same amorphous ribbon as a resonator, but uses "semi-hard" magnetic materials as the bias component, which can be deactivated and re-activated repeatedly. The bias material is the key part of the AM labels and determines the frequency and amplitude of the AM labels. The bias material affects the performance of the anti-theft labels and the cost of manufacturing. Attempts have been made to develop new bias materials and to improve the manufacturing processes for the anti-theft security labels. For example, U.S. Pat. No. 4,536,229 issued to Sungho Jin, et al on Aug. 20, 1985, is directed to a cobalt free Fe—Ni—Mo semi-hard magnetic alloy suitable for security devices. In U.S. Pat. No. 5,351,033, granted to Nen-Chin Liu, et al on Sep. 27, 1994, a method for making semi-hard magnetic elements is disclosed. Magnetic strips manufactured by annealing a iron-manganese alloy and then cold-rolling the alloy and heat treating the strips to provide strips for use in EAS systems are taught in U.S. Pat. No. 5,716,460, granted to Neil Manning, et al on Feb. 10, 1998.

U.S. Pat. No. 5,729,200, issued to Richard Copeland, et al on Mar. 17, 1998, and U.S. Pat. No. 6,181,245, issued to Richard Copeland, et al on Jan. 30, 2001, taught an anti-theft marker that is formed with semi-hard bias materials with lower coercivity that can be deactivated by applying a lower level AC magnetic field. In U.S. Pat. No. 6,001,194, granted on Dec. 14, 1999, to Noriyuki Nakaoka, and in U.S. Pat. No. 6,893,511, granted on May 17, 2005, to Noriyuki Nakaoka, a method of producing a bias material for use as a magnetic marker in an anti-theft device is disclosed in which the magnetic marker is formed with a non-magnetic copper group dispersed within an iron-based matrix, thus forming a semi-hard magnetic material. U.S. Pat. No. 6,689,490, issued on Feb. 10, 2004, to Hartwin Weber, et al, discloses a method of manufacturing an activation strip for use in an anti-theft label by using a Fe—Ni—Al—Ti based semi-hard magnetic material.

In David Jile's book "Introduction to Magnetism and Magnetic Materials" published by Chapman & Hall (ISBN0-412-38640-2), page 269-270, the definition of soft magnetic material is having "a coervicity"<1000 A/m (<12.5 Oe) while hard magnetic material is having "a coercivity">10,000 A/m (>125 Oe). The semi-hard magnetic material is a group of ferromagnetic materials that have DC coercive force (or "DC coercivity", "DC Hc") between that of soft magnetic materials and that of hard magnetic materials, which meanwhile have high remanence (e.g. all commercially available semi-hard magnetic materials have the Br much higher than 7 kGs). The comparable "coercivity" between various groups of magnetic materials is its intrinsic property. Coercivity measured under a DC field (DC Hc) removes non-intrinsic variable components of coercivity (e.g. frequency, sample size and shape, resistivity of the material, etc) so that the DC Hc can be used to compare the intrinsic magnetic properties of various magnetic materials. However, as we will discuss further, it is not enough to use DC Hc to judge whether a particular magnetic material is particularly suitable as bias component for an AM security label. Instead, we have to use the AC coercivity (AC Hc) that is the reverse field strength at the point on the AC B-H loops when the B=0. It is the reverse field needed to drive a particular magnetic component with special dimensions and resistivity under particular frequency and wave form. Traditionally, AC Hc is not used to measure semi-hard materials or permanent magnetic materials but usually to be used to judge soft magnetic materials.

Permanent magnets usually are brittle and are difficult to cold work; therefore, it is difficult to cold roll permanent magnetic materials into thin strips (e.g. about 0.05 mm thick). Soft magnetic metal materials are much easier to work into thin strips, but were not considered for use as the bias piece, due to concerns such as: the marker with soft magnetic material bias piece might be self-deactivated in the interrogation zone by the reversal pulse fields; or the soft magnetic bias piece might not give enough bias field strength. As a result, it has been a well-established practice that "semi-hard" magnetic materials (DC Hc>12.5 Oe) were required to be used as the bias component in AM labels. A specific example of this requirement can be found in the aforementioned U.S. Pat. No. 6,689,490, assigned to the current supplier of the semi-hard bias material used in AM labels, Vacuumschmelze GmbH, at column 1, line 44-47, "On the other hand, however, an adequate opposing field stability is also required, as a result whereof the lower limit value of the coercive force is determined. Only coercive forces of at least 10 A/cm are thereby suited". 10 A/cm converts to 12.5 Oe. Consequently, all prior developments and related patents on materials for the bias piece used in AM labels are limited to "semi-hard magnetic materials". No prior commercial AM labels use a bias material with its DC Hc lower than 12.5 Oe.

A "semi-hard" magnetic material generally has complicated multi-phase structure and has a ductile matrix mixed with at least one hard magnetic phase. The ductile matrix phase is needed for good cold workability; however, a low temperature (e.g. below 650° C.) aging or annealing must be used to control the hard-magnetic phase precipitation morphology and amount to get the required DC Hc and DC Br. Such low temperature heat treatments require long processing time. Furthermore, DC Hc is highly sensitive to slight temperature variations during low temperature heat treatments. In fact, to achieve high lot-to-lot consistency of the semi-hard material bias material's DC Hc and DC Br is a very challenging task in massive production. A slight temperature fluctuation within a big annealing furnace's different locations could end up with the big DC Hc and DC Br scattering in the finished strip. Most such heat treatments are non-recoverable meaning the strip with thin thickness will have to be scraped if the final properties failed to meet the requirements. This lack of consistency could lower the yield and reduce the production reliability and, consequently, increase the cost for AM labels.

Prior AM labels (such as is described in U.S. Pat. No. 6,359,563, granted on Mar. 19, 2002, to Giselher Herzer, and shown particularly in FIGS. 3 and 4 thereof) include an elongated plastic housing and cover. The cover includes a first cover film, double side tape, a bias piece made with a semi-hard magnetic material, and another cover film. The resonating cavity inside the housing holds one or two resonator pieces. The resonator pieces will typically have a bowed shape across the width dimension. The bias piece is formed as a parallelogram with two sharp corners being cut off. All prior AM labels have used "semi-hard" magnetic materials as the bias piece. The technologies to make semi-hard magnetic material for AM labels are quite complicated, and the materials are not widely available, thus leading to the higher cost.

Furthermore, the DC Hc of the semi-hard magnetic material is higher (e.g. all semi-hard magnetic materials are higher than about 20 Oe in prior commercially available bias materials), as well as higher DC Br (e.g. generally higher than 15 kGs) than that of soft magnetic materials. The higher DC Hc and DC Br values from semi-hard magnetic bias component produce a stronger bias field that will cause unavoidable strong "clamping" effect to attract resonator pieces that reduces the resonance amplitude of the AM label. Consequently, many measures in prior AM labels have to be taken to minimize this clamping effect. Examples of such measures are: making the resonator strip with a transverse bowed shape; forming the bias piece in a non-rectangular configuration; and/or increasing the label thickness by placing the bias piece outside of the resonating cavity of the housing to create enough separating distance between the bias material and the resonator pieces.

In a high speed manufacture process, the accurate positioning of the multiple sealing plastic films for the thin semi-hard bias piece outside of the resonating cavity of the house makes the label production equipment and the manufacturing process more complex with resultant higher costs. Furthermore, the non-flat resonator strip is prone to change its resonant frequency due to slight stress or pressure changes compared to flat ones, according to Dimitris Kouzoudis et al, as is reflected in "The Frequency Response of Magnetoelastic Sensors to Stress and Atmospheric Pressure", Smart Mater. Struct. 9 (2000) pp 1-5.

Prior research and development on bias materials used in AM labels were all limited to semi-hard magnetic materials. The difference between "DC coercivity" and "AC coercivity" is not appreciated. All referred "coercivity" in the prior art AM devices was only the "coercivity" being measured in direct current (DC Hc). However, it is critical to recognize that the "coercivity" measured specifically at 58 kHz alternative current (AC Hc) is a real specification to judge the stability of a particular bias thin strip with specific dimensions. AC Hc is a true material stability test for AM labels because such labels are used in a high frequency field, such as 58 kHz, instead of being used in a DC field.

DC Hc is determined by applying a reversal magnetic field slowly then measure what the peak reversal field strength is needed to fully drive the material's magnetic induction to zero. However, DC tests cannot truly reveal the behavior of the bias piece at high frequency field 58 kHz where the field strength changes very quickly. AC coercivity is the peak reversal field strength that is needed to drive a magnetic component with particular dimensions to zero magnetic induction, when a high frequency AC magnetic field is applied. DC Hc is only a material's intrinsic magnetic property while AC Hc is the combination effects of the material intrinsic magnetic properties, AC frequency and its wave form, conductivity of the material, and the size/shape of the component made with the material under test. Therefore, AC Hc is a much better measurement to be closer to reflect true performance of a particular magnetic component at a specific AC field working environment than DC Hc.

All prior works overlooked the well-known physics phenomenon in designing a bias component for an AM label, namely, the AC coercivity increases with increased frequencies, especially for a magnetic component made with lower DC Hc. The data and its mechanism can be found in many literatures, for examples: F. Marthouret et al. "Modeling of a Non-linear conductive magnetic circuit" IEEE Trans. on Mag. Vol 31, No 6, pp 4065-4070 (November 1995), D. C. Jiles, "Frequency dependence of hysterisis curves in conducting magnetic materials" J. Appl. Phys. 76 (10), pp 5849-5855 (November 1994), Jan Szczyglowski, "Influence of eddy currents on magnetic hysterisis loops in soft magnetic materials" J. Magnetism and Magnetic Materials, 223, pp 97-102 (2001).

Accordingly, it would be desirable to provide an anti-theft security tag that can be manufactured with lower cost materials to trigger an alarm when passing through a standard detection apparatus, and is also capable of being deactivated more reliably and more easily so as to pass through the standard detection apparatus without triggering the alarm.

SUMMARY OF THE INVENTION

It is an object of this invention to overcome the aforementioned disadvantages of the known prior art by providing an anti-theft security label that is manufactured with lower cost soft magnetic material as bias component.

It is a feature of this invention that the soft magnetic biased anti-theft AM security tag will trigger an alarm when passing through a standard detection apparatus.

It is an advantage of this invention that the anti-theft security tag is manufactured with lower cost soft magnetic material as the bias piece.

It is another advantage that the soft magnetic bias material can be produced through a more simple manufacturing process than semi-hard magnetic bias material previously used in the manufacture of anti-theft AM security labels.

It is another feature of this invention that the bias material can be formed with a ductile soft magnetic material that is cold rolled with reduction rate of at least 80% to maintain its DC Hc below 12.5 Oe.

It is still another advantage that the soft magnetic material from which the bias piece of the anti-theft AM security tag is manufactured does not require any heat treatment at final finish thickness and, thus, is a simple, single metallurgical phase structure instead of a multiphase structure in which all known semi-hard magnetic materials are formed.

It is another object of this invention to overcome the deficiencies in known prior technologies by providing an AM label formed with a bias piece made with soft magnetic materials.

It is still another feature of this invention that the bias piece of an anti-theft AM security tag is formed from a ductile Fe-based or Ni-based soft magnetic metal strip, such as SPCC low carbon steel strip, 1008 low carbon steel thin strip, 49Ni—Fe thin strip, 50Ni—Fe strip.

It is still another object of this invention to provide an AM anti-theft marker having the bias piece made with soft magnetic material manufactured to include in an elongated housing a magnetic bias piece inside or outside the resonating cavity of the housing, a resonator piece or pieces inside the resonating cavity of the house, and a cover film preferably arranged in a layered structure.

It is yet another feature of this invention that the AM anti-theft labels can be formed with one or more resonator pieces with a soft magnetic bias component.

It is still another feature of this invention that the soft magnetic bias piece can be placed inside the resonating cavity of the house, below or above or sandwiched by the resonator pieces with a soft magnetic bias component.

It is yet another advantage of this invention that soft magnetic materials with low DC Hc (<12.5 Oe) can be used as the bias component of AM labels.

It is still another advantage of this invention that AM labels with a soft magnetic bias component can be detected in commercially available 58 kHz detection systems without experiencing self-deactivation by the 58 kHz reversal pulse field.

It is a further feature of this invention that the soft magnetic bias material has very good consistency of DC Hc and DC Br from one manufactured lot to another manufactured lot because no heat treatments are required at finish thickness and having a simple, single metallurgical phase structure.

It is a further advantage of this invention that labels with soft magnetic bias pieces have a much better deactivation performance showing significantly longer effective deactivation distance from the deactivator surface.

It is still a further advantage of this invention that the anti-theft labels having a soft magnetic bias piece provide a significantly more reliable deactivation at same distance compared to prior AM anti-theft labels manufactured with semi-hard magnetic bias materials.

It is yet a further advantage of this invention that the anti-theft AM security tags manufactured with a soft magnetic bias piece have a significantly lower incidence of a "false alarm" compared to security tags using semi-hard magnetic bias pieces.

It is another advantage of this invention that the "clamping" effect experienced in previous AM anti-theft tags is diminished to a negligible degree due to a lower peak bias field from the soft magnetic bias piece.

It is another feature of this invention that the resonator piece can be formed in a flat configuration and the bias piece can be formed in a rectangular shape for easier manufacturing of the anti-theft AM security markers.

It is still another feature of this invention that the soft magnetic bias piece and resonator pieces can be placed together and sealed inside the resonating cavity of the housing of the anti-theft security tag.

It is still another advantage of this invention to simplify the AM label configuration, reduce the thickness of the security tag, and provide better resonating frequency stability.

It is yet another advantage of this invention that by placing the soft magnetic bias piece and the resonator piece or pieces together inside the resonating cavity of the security tag housing, the cost associated with a rapid and precision positioning the bias piece outside of the resonating cavity of housing, glue, and multiple sealing experienced with the manufacturing of current anti-theft AM security labels is no longer needed.

It is still another object of this invention to provide a lower bias field, which is particularly suitable for cobalt-free amorphous ribbons to reach the peak resonating amplitude, which reduces the cost of manufacturing the resonator pieces.

It is a further object of this invention to provide an AM anti-theft security tag manufactured with a soft magnetic bias piece that is durable in construction, lower cost of manufacture, facile in assemblage, and simple and effective in use.

These and other objects, features and advantages are accomplished according to the instant invention by providing an acoustic-magneto (AM) anti-theft marker formed with the bias piece made from a soft magnetic material, instead of a "semi-hard" magnetic material that has been used in conventional anti-theft AM security markers. The method of manufacturing such soft magnetic bias pieces includes cold deforming a soft magnetic material with at least an eighty percent reduction rate, while keeping its DC coercivity below 12.5 Oe. The strip or wire of soft magnetic material is cut to size as required for the bias piece. The anti-theft AM security marker has the soft magnetic bias piece placed inside or outside of the resonating cavity of the housing for the security tag with the flat strip resonator pieces placed inside the resonating cavity with a cover film placed over the housing. The soft magnetic bias piece or pieces effectively operate close to resonator piece or pieces with or without a non-magnetic separating film.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a table showing a computerized recorded AC measurement data on a bias component made with a 49Ni—Fe soft magnetic material.

FIG. 3 is an exploded view of a prior art AM security label using a semi-hard magnetic bias piece;

FIG. 4 is a cross-sectional view of the prior art anti-theft AM security label depicted in FIG. 3;

FIG. 5 is an exploded schematic view of a first embodiment of an AM anti-theft security tag incorporating the principles of the instant invention;

FIG. 6 is a cross-sectional view of the anti-theft security tag shown in FIG. 5;

FIG. 7 is an exploded view of an alternative embodiment of an anti-theft security tag incorporating the principles of the instant invention;

FIG. 8 is a cross-sectional view of the security tag depicted in FIG. 7;

FIG. 10 is an exploded view of a third alternative embodiment of an anti-theft security tag incorporating the principles of the instant invention;

FIG. 11 is a cross-sectional view of the security tag depicted in FIG. 10;

FIG. 12 is an exploded view of a fourth alternative embodiment of an anti-theft security tag incorporating the principles of the instant invention;

FIG. 13 is a cross-sectional view of the security tag depicted in FIG. 12.

DETAILED DESCRIPTION OF THE PREFERRED EMBODIMENT

Figure 1A:
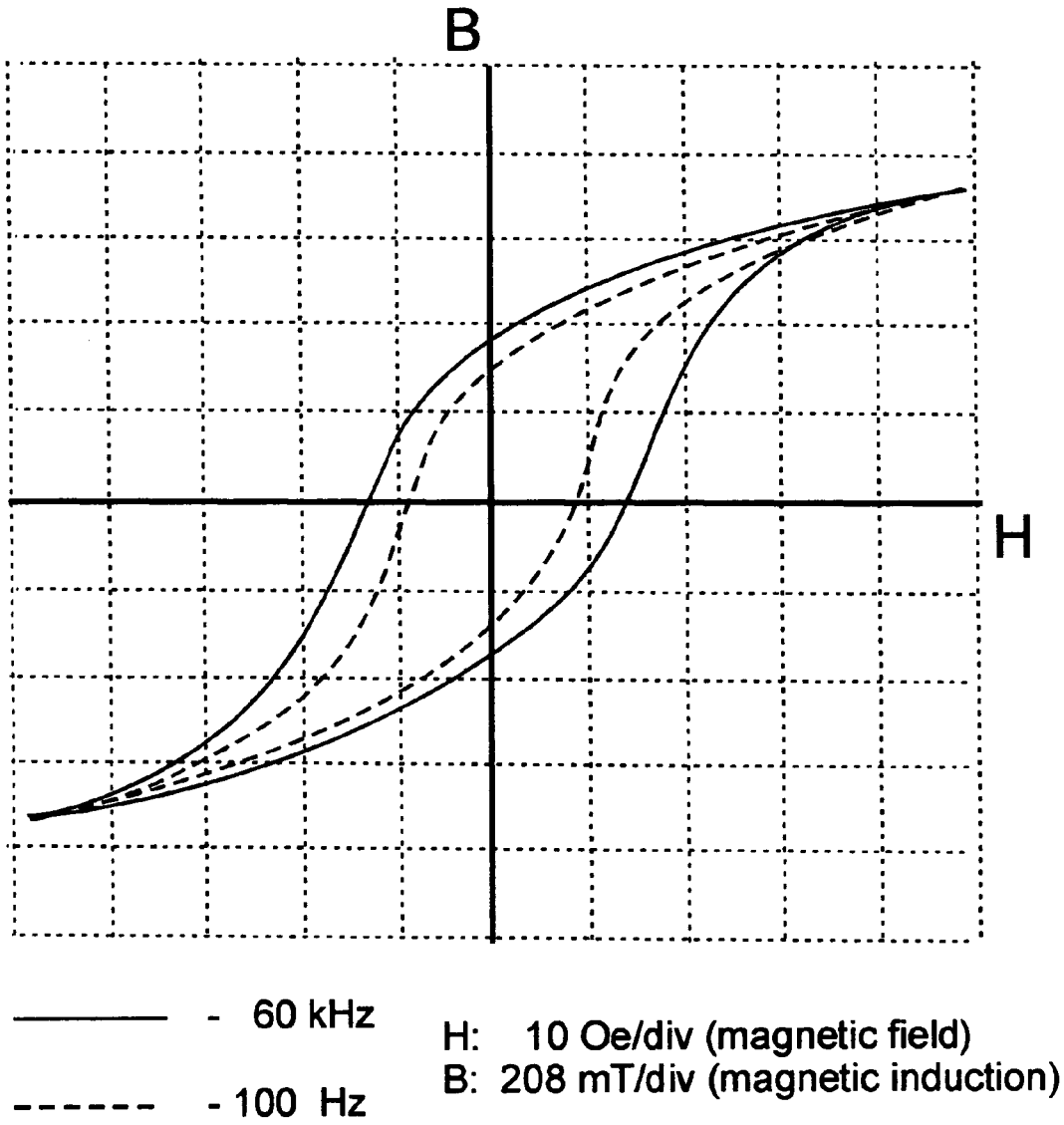
FIG. 1A is a graph depicting the AC coercivity of a 49Ni—Fe soft magnetic bias strip increases as the frequency increases.

Referring to FIGS. 3 and 4, an acoustic-magneto (AM) anti-theft security tag manufactured according to the known prior art technology can be seen. The anti-theft security tag 10 includes a housing 12 defining a resonating cavity 13 in which resonator pieces 14 are placed. A cover film 16 closes the resonating cavity 13 with the resonator pieces 14 positioned within. The semi-hard magnetic bias piece 15 is positioned outside of the resonating cavity 13 between the cover film 16 and the cover 17 trapping the semi-hard magnetic bias piece 15 between the cover 17 and the intermediate cover film 16. When activated, the semi-hard magnetic bias piece 15 causes the resonator 14 to resonate mechanically at a frequency within the range of the detection apparatus (not shown). Demagnetizing the semi-hard bias piece 15 causes the resonation of the resonator piece 14 to shift outside the frequency range of the field applied by the detection apparatus, which can accomplish deactivation of the AM security tag 10. Once deactivated, the security tag 10 can pass through the interrogation field applied by the detection apparatus (not shown) without raising the alarm. The operation of the AM anti-theft marker is well known to one of ordinary skill in the art and a more detailed explanation is not necessary.

Conventional practice utilizes semi-hard magnetic material as the bias piece in the disposable labels so that the bias material will not be deactivated in the standard detection apparatus. By setting a minimum DC coercivity, and, therefore, using semi-hard magnetic material in the formation of the semi-hard magnetic bias piece 15, the bias material would not be in danger of becoming demagnetized by the interrogation field of the detection apparatus. The concern was that the interrogation field could have a peak as high as 12.5 Oe in a real security label detection system. As is noted in greater detail below, the 58 Hz AC coercivity is the final important property to see if the bias material can be stable or not in the interrogation field, not DC coercivity as referred in all prior arts documents relating to this subject.

Semi-hard magnetic material is manufactured by carefully controlled manufacturing parameters to provide a material having consistent DC Hc and DC Br properties. The material must be heat treated within very strict temperature controls to provide satisfactorily operable material for the bias pieces. As a matter of fact, most final heat treatments to form a semi-hard magnetic material for use as a bias material in prior AM labels are irreversible. Namely, it is a "hit or miss" process with great risk involved. If a final heat treatment cannot reach a targeted combination of DC Hc and DC Br to provide a good bias function for prior AM labels, the strip will no longer be salvageable by any other means. Consequently, a failed final heat treatment will result in scraping the entire lot being processes at final thin gauge after enormous process from melting. In contrast, the soft magnetic bias material can be manufactured very easily. For example, by using Fe-based or Ni-based cold rolled strip or wire with big cold reduction (e.g. >90%) without heat treatment needed, we will get high consistency properties from lot-to-lot in the manufacturing process. With no uncertainties in the manufacturing process, each lot produces qualified soft magnetic bias material. More particular examples are: a Fe—Ni alloy (the commercial example is 49Ni—Fe) strip material, as well as low carbon Fe strip, is widely used as soft magnetic strips. These alloys have single phase and easy cold formability.

Although they have never been considered for using as AM label's bias material, these soft magnetic alloys are widely available materials with manufacturing experience spanning several decades and were available long before the existence of the semi-hard bias materials as well as the AM labels. In contrast, current semi-hard bias materials always are patented special material compositions with complicated processes. The as-rolled DC coercivity and DC remenance of soft magnetic alloys become insensitive to the process parameters and become uniformly consistent after a heavy cold reduction such as >90%. No further heat treatment is needed after cold rolling the material at finished thickness for use as bias material for AM labels. The homogenity of the whole batch, as well as the batch to batch consistency is superior, compared to the semi-hard magnetic materials that go through various low temperature heat treatments under controlled atmospheres with difficult handling on annealed thin gage strip.

The reduced DC Hc of soft magnetic bias materials enables a significantly longer deactivation distance. Unlike the detection system operated at high frequency at 58 kHz, the AC deactivation field frequency can be designed as low as power line frequency such as 50-60 Hz. In such low frequency, the eddy current is low and the material has AC coercivity close to DC coercivity, which is at about or below 12.5 Oe. Therefore, the lower deactivation peak field at 12.5 Oe is enough to deactivate the soft magnetic bias material, while semi-hard bias material cannot be deactivated with DC Hc greater than 20 Oe at same distance.

The lower DC coercivity of the soft magnetic bias piece 25 provides just enough bias field without excess magnetic force to clamp the flat resonator piece 24. Prior AM security label 10 incorporated many measures to reduce such clamping effect: such as making resonator piece 14 with a transversely curled shape, as depicted in FIG. 3, and/or increasing the thickness of the cover film 16 to create enough distance between the semi-hard magnetic bias piece 15 and the curled resonator piece 14 to reduce attraction force therefore to prevent clamping. The transverse curled resonant strip 14 is not as good as a flat strip configuration 24 in keeping the stability on resonant frequency.

The magnetically softer bias material has much less or nearly zero "clamping" effect on the resonator pieces compared to a same size (e.g. 0.05 mm thick) semi-hard magnetic material. Therefore, the resonator pieces 24 can be flat instead of being curled shape resonator piece 14 across width. The fact that 49Ni—Fe soft magnetic material can be used in AM labels destroys the conventional notion that the bias material has to be high in DC Br in order to get enough flux level at thin gage such as 0.05 mm. All known prior semi-hard materials have a higher DC Hc (>12.5 Oe) as well as high DC Br (e.g. about 12-18 kGs). In contrast, our one specific example showing that the 49Ni—Fe soft magnetic bias piece with its DC Br is less than 7 kGs but showing acceptable bias function, when the strip is same thin thickness of 0.05 mm, to make an active and detectable AM label in commercially available Ultramax detection system. This clearly demonstrated that high DC Br is not necessary which combined with higher DC Hc could cause adverse "clamping" effect.

The soft magnetic bias material does not require curled resonator pieces, and operates satisfactorily with flat ones. With a bias piece formed as a flat strip, a wire or other elongated shape, the anti-theft AM security label can be manufactured thinner. Another embodiment of the bias piece would be to place multiple wires in a parallel array, for example on a piece of pressure sensitive tape or double tape. Still another embodiment of the instant invention utilizes a triangle shape bias material with acceptable performance. This embodiment can effectively reduce the half weight of the bias strip needed for the same function. This is half cost reduction for making an equivalent or better AM label. In summary, the thin soft magnetic bias piece (e.g. 0.05 mm) has nearly zero "clamping" effect. Therefore, all previously utilized complicated measures to offset "clamping" effect become unnecessary. More favorably, the soft magnetic bias piece 25 can now be placed inside the resonating cavity of the house together with the resonator pieces 24, which much simplified the label production process.

One of the major advantages of using low DC coercivity bias material is that we can use cheaper resonator material. In Anderson's '489 patent, Fe—Si—B amorphous was listed as having the highest magneto-elastic exchange factor k, which is listed as suitable for AM label application. However, the bias field needed to get the maximum coupling is lower compared to that for a cobalt-contained amorphous resonator. Prior semi-hard magnetic materials give a higher bias field that is suitable for the cobalt-contained resonators that need higher bias field to reach maximum coupling exchange. Therefore, the semi-hard bias materials are not suitable for Fe—Si—B resonator that needs much lower bias field. Now, the soft magnetic bias materials, with its lower bias field, make it possible to use much cheaper Fe—Si—B amorphous as the resonator material.

One example to manufacture soft magnetic bias pieces, start with a coil of 100 mm wide, 0.5 mm thick 49Ni—Fe strip, which is widely available in the marketplace, cold roll with a four-high rolling mill directly down to 0.05 mm thick with cold reduction rate greater than 80%, preferably greater than 90%, but maintaining the DC Hc still below 12.5 Oe. In our specific case, the DC Hc is about 8.5 Oe for 49Ni—Fe soft magnetic bias material as manufactured. The coil is then slit into strips about 7 mm wide, which are then cut into 32-35 mm long pieces with a high speed shear utilizing an automatic feeder. The soft magnetic bias pieces do not need any heat treatments at 0.05 mm final thickness.

FIG. 1 and FIG. 1A are the table and graph of the data to show that the AC Hc of a soft magnetic bias piece formed as described above, FIG. 1A being the graphic form of the data expressed in FIG. 1. The AC Hc is significantly higher than DC Hc. At 58 kHz, the AC Hc is typically at least 60% higher than the DC Hc, reached 13-16 Oe, although the DC Hc is below 8.5 Oe, which prevents AM labels formed with soft magnetic bias pieces from being deactivated by the 58 kHz reversal pulse field in high frequency detection systems. The DC Hc and DC Br from the bias strip made as described above are very consistent, thus enabling AM labels to be manufactured with consistent quality.

Figure 2:
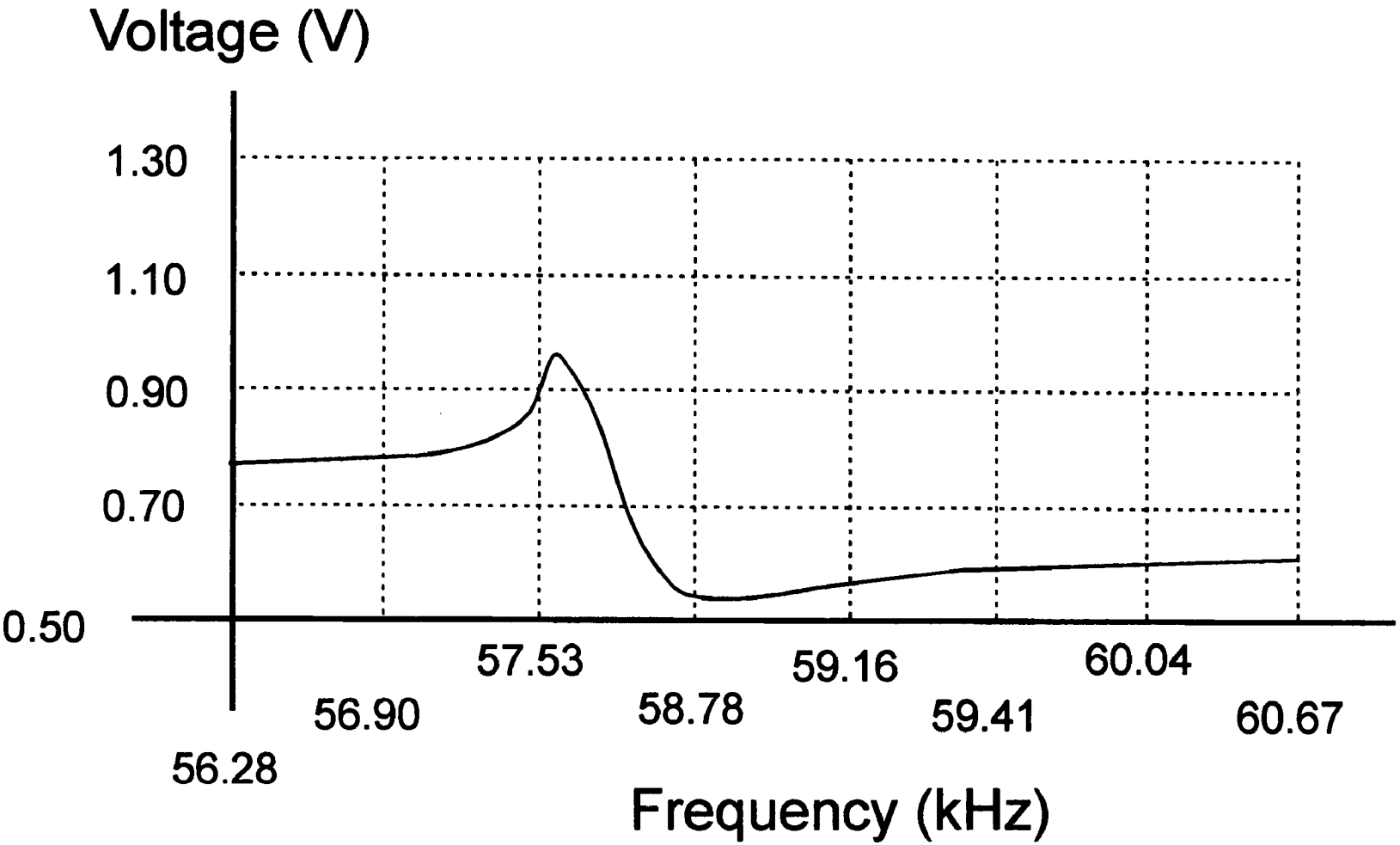
FIG. 2 is a typical frequency spectrum from a Fe40Ni38Mo4B18 amorphous resonator piece biased by a 49Ni—Fe soft magnetic bias piece.

FIG. 2 shows a typical frequency spectrum from the Fe40Ni38Mo4B18 amorphous resonator piece (such as is disclosed in the aforementioned U.S. Pat. No. 4,510,489), biased by a 32×7×0.05 mm 49Ni—Fe soft magnetic bias piece. The graph shows the resonant and anti-resonant peaks, indicating that the AM anti-theft label manufactured with a soft magnetic material bias piece can have resonant frequency being controlled around 58 kHz.

As a test of the soft magnetic biased AM security labels, a narrow deactivator commercially available from SEC under the name of "Scanmax Slim-Pad Pro" was employed by placing activated AM labels with the elongated direction thereof oriented parallel to the surface of the deactivator at various distances from the deactivator, as listed in Table I below. The deactivator was triggered with a permanent AM security tag to release the AC demagnetization field. The exposed soft magnetic biased AM security labels were then checked with a label detector (commercially available under the name of "Double Checker" made by SEC) to check the deactivation performance. The test was duplicated using semi-hard magnetic biased security labels (DR labels) commercially available from SEC for comparison purpose.

As is reflected in Table I below, the soft magnetic biased AM security labels incorporating the principles of the instant invention demonstrated significantly better deactivation performance when compared to the presently commercially available semi-hard magnetic biased AM security labels. The soft magnetic biased AM security labels increased effective deactivation distance to 24 cm compared to the corresponding distance of 15 cm for the semi-hard magnetic biased AM security labels. The instant invention greatly enhances the deactivation reliability to big articles or whole box of articles attached with AM labels (i.e. "source tagging").

TABLE I

Deactivation performance comparison of DR security labels (with semi-hard magnetic bias piece) and security labels incorporating the instant invention (with soft magnetic bias piece, used 49Ni—Fe in this example) exposed to the same deactivation field.

| | AM labels | |
|---|---|---|
| Exposure distance from the surface of the deactivator | Semi-Hard Magnetic biased | Soft Magnetic biased |
| 15 cm | Fully deactivated | Fully deactivated |
| 16 cm | Partially deactivated | Fully deactivated |
| 17 cm | Failed deactivation | Fully deactivated |
| 18 cm | Failed deactivation | Fully deactivated |
| 19 cm | Failed deactivation | Fully deactivated |
| 20 cm | Failed deactivation | Fully deactivated |
| 21 cm | Failed deactivation | Fully deactivated |
| 22 cm | Failed deactivation | Fully deactivated |
| 24 cm | Failed deactivation | Fully deactivated |
| 25 cm | Failed deactivation | Partially deactivated |
| 26 cm | Failed deactivation | Failed deactivation |

Deactivator: SEC's "Scanmax Slim Pad Pro"
Label detector: SEC's Double Checker
DR Label: Semi-hard bias piece + two FeNiCoSiB resonators
Soft Magnetic biased Label: 49Ni—Fe bias piece + two FeNiMoB resonators
Fully deactivated: no alarm at Double Checker's surface
Partially deactivated: alarm at 1-10 cm away from Double Checker's surface
Failed deactivation: alarm at >20 cm away from Double Checker's surface Referring now to FIGS. 5 and 6, an AM security label 20 incorporating the principles of the instant invention can best be seen. The security label 20 includes a housing 22 defining a resonating cavity 23 in which is placed the soft magnetic bias piece 25 and a pair of resonator pieces 24. The housing 22 is preferably thermal-formed from polyvinyl chloride (PVC) material having a thickness of 0.3 mm, although other known packaging films commonly used for medicines or foods could be utilized. The shape of the resonating cavity 23 is preferably rectangular. Similarly, the soft magnetic bias piece 25 is a flat rectangular member preferably formed from a 49Ni—Fe strip. The two resonator pieces 24 are preferably placed above the soft magnetic bias piece 25 and are also preferably formed in a flat rectangular configuration to fit within the resonating cavity 23. The area of the soft magnetic bias piece 25 should be smaller than the resonating cavity 23 in order to provide enough space for the resonator pieces 24 to resonate. The resonating cavity 23 is closed by applying a cover 27, preferably formed from double side tape with liner placed on a rectangular shaped cover film affixed to the top of the housing 22.

Table II below shows the effect of different locations of the soft magnetic bias piece 25 on the detection performance of the AM security labels 20. Samples A and B of the soft magnetic biased security label, incorporating a 49Ni—Fe 32×7×0.05 mm bias piece 25 placed inside the resonating cavity 23 of the housing 22 with a resonator piece formed of FeNiMoB amorphous strip, were tested using a commercially available label detector (Double Checker manufactured by SEC) to determine the detection distance. The results of this test show that the exact position of soft magnetic bias piece 25 inside the resonating cavity 23 does not affect the label detection performance significantly. Accordingly, a significant advantage of the instant invention is that no specific requirement for the exact position of the soft magnetic bias piece 25 is mandated. As a result, production and equipment costs can be substantially reduced.

TABLE II

Effect of different positions of the soft magnetic bias piece (49Ni—Fe 32 × 7 × 0.05 mm) within the resonating cavity with respect to the detection performance of the soft magnetic biased AM security labels.

| Position of the soft magnetic bias piece inside the resonating cavity | The longest distance that an active soft magnetic security label can be detected by a double checker (cm): Soft Magnetic Label A | | Soft Magnetic Label B | |
|---|---|---|---|---|
| | Direction 1 | Direction 2 | Direction 1 | Direction 2 |
| left side | 22 | 23 | 20 | 25 |
| middle | 21 | 23 | 22 | 23 |
| right side | 19 | 22 | 22 | 23 |

Note:
(1) Direction 1 is with the long axis of the security label perpendicular to the double checker's surface.
(2) Direction 2 is reversal to direction 1
(3) Additional earth field bias effect in various directions caused slight variations in detection distances.

Referring now to FIGS. 7 and 8, the soft magnetic biased AM security label 20 is formed substantially like the prior art AM security label 10 in FIGS. 3 and 4. The housing 22 defines the resonating cavity 23 in which the resonating pieces 24 are positioned. An intermediate cover film 26 seals off the resonating cavity 23. The soft magnetic bias piece 25 is placed on top of the intermediate cover film 26 and then covered with a top cover 27 that is formed from a cover film and double sided tape, as described above. This configuration allows existing AM label production equipment can simply replace semi-hard bias material with soft magnetic bias material without significant investment in equipment modification.

Figure 9:
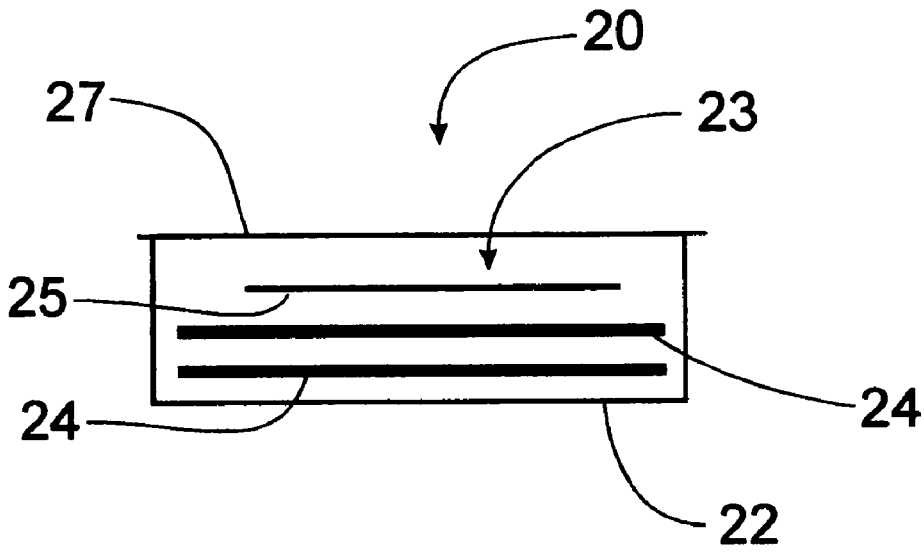
FIG. 9 is a cross-sectional view of a second alternative embodiment of the instant invention.
Figure 14:
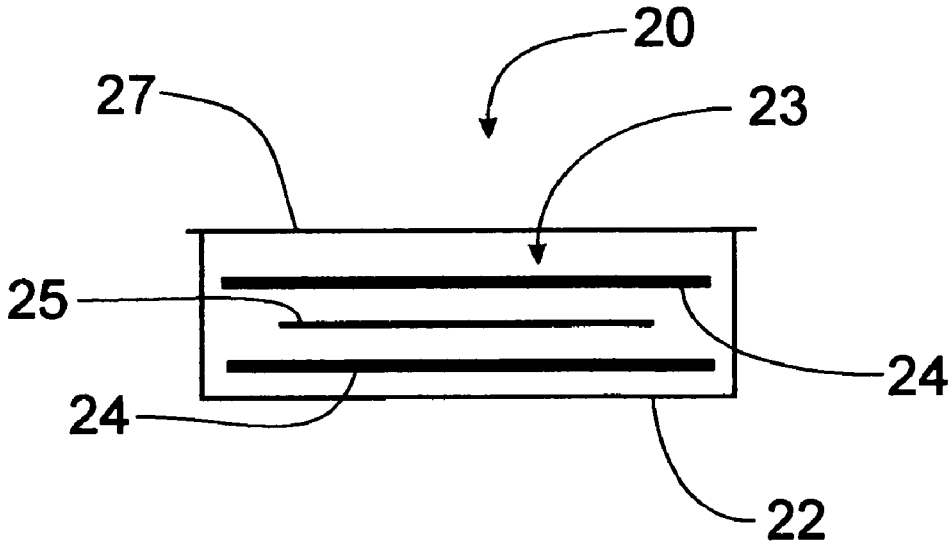
FIG. 14 is a cross-sectional view of a fifth alternative embodiment of an anti-theft security tag incorporating the principles of the instant invention.

FIG. 9 depicts a configuration of a security label 20 that is similar in structure to the embodiment depicted in FIGS. 5 and 6, but with the soft magnetic bias piece 25 placed on top of the resonator pieces 24. FIGS. 10 and 11 depict yet a different configuration, though also similar to the structure of FIGS. 5 and 6, but utilizing only a single resonator piece 24, instead of two resonator pieces 24 as is conventional with AM security labels for lower cost and easier manufacturing. FIGS. 12 and 13 depict yet another configuration in which two bias pieces, though more than two bias pieces can be used, with one bias piece 25 being located below the resonator piece 24 in the resonating cavity 23 and the other bias piece 25 being located above the intermediate cover film 26. FIG. 14 depicts yet a different configuration of a security label 20 that is similar in structure to the embodiments shown in FIGS. 5, 6 and 9, but placing a single flat soft magnetic bias piece 25 sandwiched between two resonator pieces 24, housed within the resonating cavity without fixing the position of the bias piece 25.

The utilization of the soft magnetic bias piece in an AM security label enables the configuration of the housing 22, and arrangement of the soft magnetic bias piece 25 and the resonator piece(s) 24 within and outside the resonating cavity, as are described above with respect to FIGS. 5-11, to be placed in these different configurations without disruption of the effectiveness of the security label 20 in the active mode, or to be deactivated. A substantial advantage of the instant application is the reduction of the clamping effect, described above, which allows the reconfiguration of the resonator 24 and bias pieces 25 to correspond to the manufacturing machinery and process methods readily available to the manufacturer of the security tags 20, and allows the resonator pieces 24 to be manufactured in a flat rectangular configuration, rather than the transversely curved shape conventional with semi-hard magnetic biased anti-theft AM security tags.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An acoustic-magneto security label comprising:

a housing defining a resonating cavity;

a resonator piece positioned within said resonating cavity;

a soft magnetic bias piece supported on said housing proximate to said resonator piece, said soft magnetic bias piece having direct current coercivity measured in the range of 6.0-10.0 Oe and alternating current coercivity measured at 60 kHz being greater than 12.0 Oe; and a top cover affixed to said housing to seal said soft magnetic bias piece and said resonator piece within said housing.

2. The security label of claim 1 wherein both said resonator piece and said soft magnetic bias piece are positioned within said resonating cavity.

3. The security label of claim 1 further comprising an intermediate cover placed on said housing to close said resonating cavity with said resonator piece positioned therein, said soft magnetic bias piece being positioned between said intermediate cover and said top cover.

4. The security label of claim 3 wherein said resonating cavity has multiple resonator pieces positioned therein.

5. The security label of claim 2 wherein said resonator piece is positioned between said soft magnetic bias and said top cover.

6. The security label of claim 5 wherein said resonating cavity has multiple resonator pieces positioned therein between said soft magnetic bias piece and said top cover.

7. The security label of claim 1 wherein said soft magnetic bias piece has a direct current coercivity value measured in the range of 7.0 to 9.0 Oe.

8. The security label of claim 7 wherein said soft magnetic bias piece is formed in a flat configuration from a cold rolled strip of material having a cold reduction rate of at least 80 percent.

9. In an acoustic-magneto security tag having a housing defining a resonating cavity in which is positioned a resonating device and a top cover closing said resonating cavity, the improvement comprising:

at least one magnetic bias piece formed of soft magnetic material having a direct current coercivity in the range of 6.0 to 10.0 Oe, said at least one magnetic bias piece having alternating current B-H loop with 60 kHz coercivity greater than 12.0 Oe, said security tag having a resonating frequency centered at 56-60 kHz.

10. The security tag of claim 9 wherein said magnetic bias piece has a simple metallurgical uniform single phase structure without multiple phase structures.

11. The security tag of claim 10 wherein both said resonating device and said at least one soft magnetic bias piece are positioned within said resonating cavity.

12. The security tag of claim 11 wherein said resonating device is positioned between said at least one soft magnetic bias piece and said top cover.

13. The security tag of claim 12 wherein said resonating device is formed of at least one resonator piece positioned within said resonating cavity between said at least one soft magnetic bias piece and said top cover.

14. The security tag of claim 12 wherein said resonating device is formed of multiple resonator pieces positioned within said resonating cavity between said at least one soft magnetic bias piece and said top cover.

15. The security tag of claim 14 wherein each said resonator piece is formed in a flat configuration.

16. The security tag of claim 10 further comprising an intermediate cover placed on said housing to separate said resonating device and said at least one soft magnetic bias piece, said at least one soft magnetic bias piece being positioned between said intermediate cover and said top cover.

17. The security tag of claim 16 further comprising first and second soft magnetic bias pieces with said first soft magnetic bias piece being positioned in said resonating cavity and said second soft magnetic bias piece being position between said intermediate cover and said top cover, said resonating device being located between said first and second soft magnetic bias pieces.

18. An acoustic-magneto security tag comprising:

a housing defining a resonating cavity;

a resonating device positioned in said resonating cavity;

at least one magnetic bias piece formed of a soft magnetic alloy having an alternating current coercivity measured at 60 kHz greater than 12.0 Oe and constructed as a simple metallurgical uniform single phase structure without multiple phase structures; and a top cover closing said resonating cavity.

19. The acoustic-magneto security tag of claim 18 wherein said at least one magnetic bias piece has a direct current coercivity in the range of 6.0 to 10.0 Oe.

20. The acoustic-magneto security tag of claim 19 wherein said at least one magnetic bias piece is formed from a low carbon Fe strip through cold rolling said soft magnetic alloy with a reduction greater than 80% to a thickness in the range of 0.03 to 0.08 mm.

* * * * *